United States Patent [19]

Bergh

[11] 4,052,820

[45] Oct. 11, 1977

[54] PORTABLE SURFACE TREATING APPARATUS

[75] Inventor: John C. Bergh, Elkhart, Ind.

[73] Assignee: Wheelabrator-Frye, Inc., Hampton, N.H.

[21] Appl. No.: 651,183

[22] Filed: Jan. 21, 1976

[51] Int. Cl.[2] ..... B24C 3/00

[52] U.S. Cl. ..... 51/423; 51/429

[58] Field of Search ..... 51/8 SR, 9 R, 9 M

[56] References Cited

U.S. PATENT DOCUMENTS

| | | | |
|---|---|---|---|
| 3,877,175 | 4/1975 | Snyder | 51/9 M |
| 3,900,969 | 8/1975 | Diehn | 51/9 M |
| 3,934,373 | 1/1976 | Leliaert et al. | 51/9 M |
| 3,977,128 | 8/1976 | Goff | 51/9 M |

*Primary Examiner*—Al Lawrence Smith

*Assistant Examiner*—James G. Smith

*Attorney, Agent, or Firm*—McDougall, Hersh & Scott

[57] ABSTRACT

A portable apparatus for treatment of surfaces, preferably horizontal, comprising a centrifugal wheel for projecting abrasive particles onto the surface at an angle within the range of 30° to 80° with the surface, a hopper for supplying abrasive particles to the wheel, a rebound corridor extending angularly upwardly preferably to a level above the hopper and into which the abrasive particles rebound upon striking the surface and means for returning abrasive particles rebounding through the corridor to the hopper, means for intercepting abrasive particles which do not possess sufficient kinetic energy to rebound through the corridor to prevent return of said abrasive particles to the surface, and means for displacement of intercepted abrasive particles to the hopper.

13 Claims, 2 Drawing Figures

PORTABLE SURFACE TREATING APPARATUS

This invention relates to a device for treatment of surfaces with particulate material thrown at high velocity onto the surface and it relates more particularly to a portable device which makes use of one or more airless wheels having radially extending blades for throwing, by centrifugal force, particulate material such as steel shot, grit, or abrasive particles against the surface for cleaning, abrading, or other surface treatment.

Recovery for re-use of abrasive or other particulate material is essential to the successful operation of the device, otherwise the cost of particulate material or abrasive becomes excessive, the means for supplying of the large volumes of abrasive material imposes a similar problem of size and weight, and the means for disposal of spent abrasive material increases the problem of size and weight.

Recovery of particulate material and abrasives entails the problems of removal of the particulate material and abrasive from the surface after they have served their purpose, separating re-usable particulate material and abrasive from the dust, dirt and fines picked up from the surface, and returning the cleaned particulate material or abrasive for recycle to the centrifugal blasting wheel for re-use in surface treatment.

Such recovery, cleaning and recycle of cleaned particulate material and abrasive must be embodied in a unit with the centrifugal wheels and housings for confinement of the abrasive particles thrown from the wheels if the unit is intended for use as a portable surface cleaning or treating device.

Present surface treatment devices of the type described, especially for the treatment of horizontal surfaces, such as floors, ships' decks, roads, runways and the like, are very large and difficult to maneuver in relatively small areas. A great deal of the length and weight is taken up by the recovery, cleaning and recycle system for the used particulate material or abrasive.

It is an object of this invention to provide a portable surface treating device of the type described which is of a size and weight to be easily maneuverable over the surface to be cleaned or otherwise treated, in which means are provided for recovery of the re-usable abrasive or other particulate material, in which the recovered abrasive or particulate material is cleaned and recycled as feed to the centrifugal throwing wheel in a simple and efficient manner which requires a minimum of space and additional equipment, and in which the abrasive or other particulate material is substantially completely removed from the cleaned or treated surfaces thereby to minimize the loss of material, and the amount of additional cleaning required to remove the dust and residue from the cleaned or treated surfaces.

Figure 2:
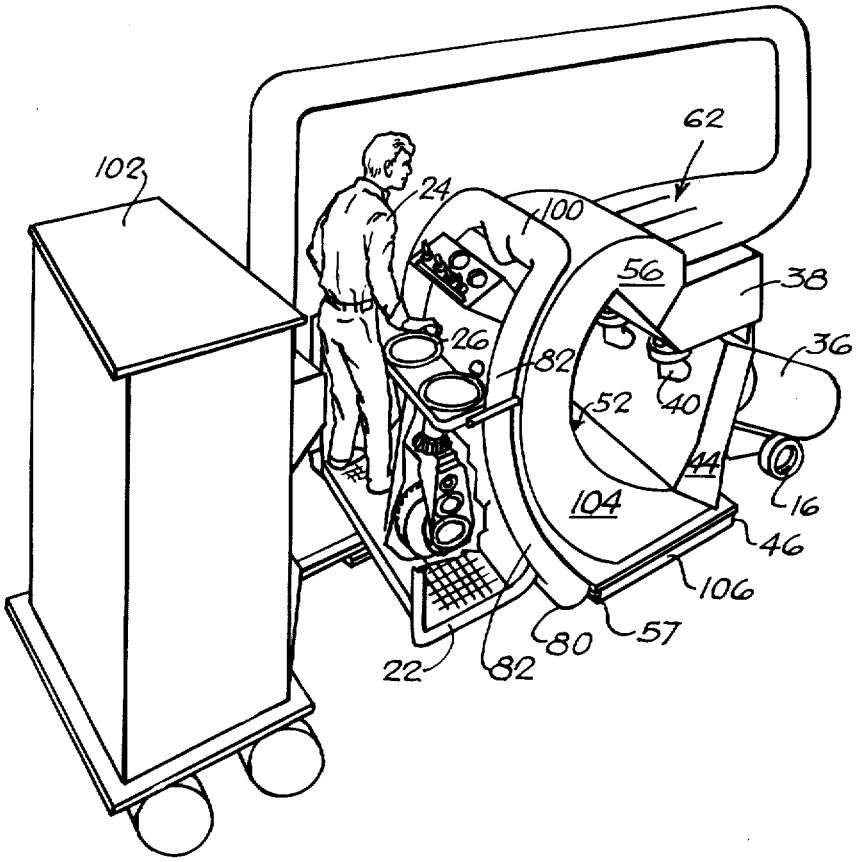
Figure 1:
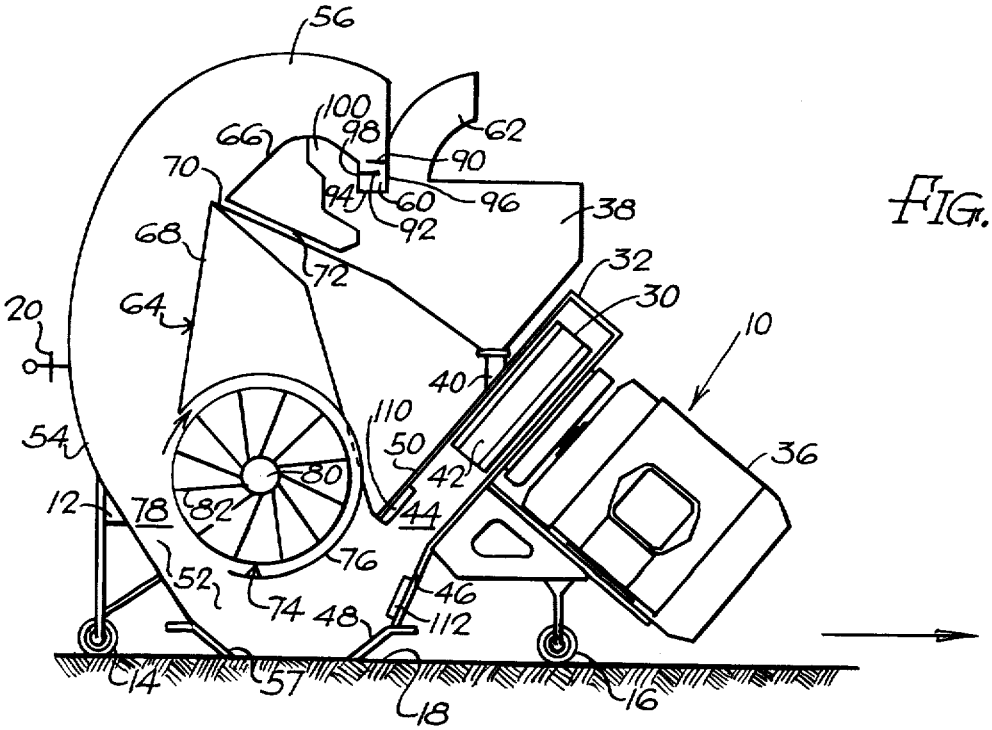

These and other objects and advantages of this invention will hereinafter appear and for purposes of illustration, but not of limitation, an embodiment of the invention is shown in the accompanying drawings, in which:

FIG. 1 is a schematic sectional elevational view showing the essential elements of a portable apparatus embodying the features of this invention for cleaning a floor, ship's deck, or other horizontally disposed surface, and FIG. 2 is a perspective view of a power driven portable unit embodying the cleaning apparatus of FIG. 1.

The invention will be described with reference to an apparatus for cleaning a horizontally disposed, relatively flat surface, such as a floor, ship's deck, airport runway, street and the like, but it will be understood that the apparatus to be described has application also for the treatment of surfaces other than flat and other than horizontal, such for example as a rolling surface, inclined surface and even a vertical surface.

While the invention will hereinafter be described with reference to the use of hard abrasive particles for cleaning such surfaces, it will be understood that the apparatus of this invention has application for the treatment of surfaces with other particulate material for use in cleaning surfaces, removal of surface finishes, hardening surfaces as by peening or impacting, and for providing certain finishes to a metal, plastic, wooden and the like surface. The type of surface treatment or finish depends somewhat upon the type of particulate material projected onto the surface such as steel shot, steel grit, metal abrasive, sand for surface cleaning, or softer materials such as particulate organic materials in the form of nut shells, nut seeds, wooden or plastic particles and the like for surface finishing, hereinafter collectively referred to as abrasive particles.

Referring now to the drawings, illustration is made of an apparatus 10 which includes a rigid frame 12 mounted on wheels 14, one of which is in the form of a caster wheel 16 for enabling movement of the apparatus in various directions over the surface 18 to be treated. The apparatus may be adapted for movement by hand, in which event handle bars 20 are provided to extend rearwardly from the frame, or the apparatus may be powered for movement over the surface, as by means of an electrical motor drive (not shown), in which event a platform 22 is provided to extend rearwardly from the frame and on which the operator 24 rides, with steering means 26 for maneuvering the apparatus over the surface to be treated.

The apparatus 10 is provided with one or more airless centrifugal wheels 30 enclosed within a protective housing 32. The wheel 30 is generally referred to as a centrifugal blasting wheel, of the type well known to the trade, and marketed by Wheelabrator-Frye Inc. of Mishawaka, Ind., under the name WHEELABRATOR. The wheel is rotated at high speed on an axle 34 driven by an electrical motor 36. Instead of a direct motor drive, rotational movement at high speed can be imparted to the wheel by means of a belt drive which interconnects a pulley on the end of the axle with a motor driven sheave offset from the wheel axis.

Abrasive particles are fed from a supply hopper 38 through a feed spout 40 to a cage in the center of the wheel. The cage dispenses the abrasive particles onto the inner end portion of the blades 42 which extend radially outwardly in circumferentially spaced relation from the hub whereby, in response to rotational movement of the wheel, the abrasive particles are displaced radially outwardly over the surfaces of the blades and thrown with high centrifugal force from the ends of the blades in a direction controlled by the cage. The rate of flow of particulate material is controlled by a control valve in the feed system.

As illustrated in FIG. 1, the wheel axle is inclined so that the abrasive particles will be thrown from the blades angularly downwardly through a similarly inclined blast corridor 44 onto the surface 18. The cleaning efficiency and rebound of the abrasive particles, for best recovery, is somewhat dependent upon the angle of inclination at which the abrasive particles strike the surface which angle corresponds to 90° minus the angle of inclination that the wheel axle makes with the horizontal. The angle of inclination that the wheel axle makes with the horizontal should be less than 60° and not less than 10° so that the angle at which the abrasive particles strike the surface will not be less than 30° nor greater than 80° and preferably within the range of 45° to 65°.

The bottom wall 46 of the blast corridor 44 terminates a short distance above the surface 18 and is provided with a resilient skirt 48 to extend therefrom into sealing engagement with the surface 18 to prevent abrasive particles from ricocheting from the blast housing, while also sealing off the interior of the blast area. The upper wall 50 of the blast corridor terminates at a higher level to define the entrant opening into the rebound corridor 52.

Advantage is taken of the kinetic energy imparted to the abrasive particles striking the surface whereby the abrasive particles rebound from the surface into the upwardly inclined rebound corridor at an angle which is somewhat less than the reflective angle at which the abrasive particles strike the surface.

In the preferred practice of this invention, the outer wall 54 of the rebound corridor 52 extends curvilinearly upwardly to define a curvilinear rebound corridor which rises to a level above the hopper 38 and terminates in an end portion 56 which extends angularly downwardly, preferably in the direction toward the hopper 38, whereby the particulate material travels substantially horizontally over a hump at the top during passage through the rebound corridor. The outer wall 54 terminates at its lower end a short distance above the surface 18 and from which a resilient skirt 57 depends into resilient engagement with the surface 18, in a manner similar to skirt 48.

A majority of the rebound abrasive particles will possess sufficient kinetic energy to carry them upwardly through the curvilinear rebound corridor into the end portion 56 for subsequent gravitational flow through an air wash separation unit 60, for removal of dust and fines, through duct 62 to a dust collector D, while the cleaned abrasive particles fall gravitationally from the air wash into the supply hopper 38 for recycle to the wheel 30.

Means are provided to prevent such abrasive particles, that do not have sufficient kinetic energy to carry them to the end of the corridor, from falling back onto the cleaned surface.

For this purpose, in the area immediately below the hump or in the region of the backwardly curved portion of the rebound corridor, the inner wall 64 of the rebound corridor is formed with a portion that extends inwardly in the direction towards the outer wall to form a ledge 70 that extends continuously crosswise of the corridor. The ledge extends into the path of particulate material that makes it beyond the ledge but lacks sufficient kinetic energy to carry all the way through the corridor and thus falls back gravitationally onto the ledge. Means are provided for returning the material collected on the ledge to the hopper. As illustrated in the drawing, one such means comprises a slide passage 72 between an upper segment 66 and a spaced lower segment 68 of the inner wall 64, which extends into the corridor to define the ledge 70 and passage 72 which extends continuously angularly downwardly therefrom.

Since the dust, dirt and fines of lesser weight remain entrained within the air current and are carried through the return corridor, the heavier materials collected on the ledge will be relatively free of fines and dust and therefore do not require cleaning before return to the supply hopper for re-use.

A paddle wheel 74 is mounted in the lower portion of the rebound corridor, within a curvilinear shroud 76, to form a part of the inner wall but with a peripheral portion of the paddle wheel extending into the return corridor, but spaced a short distance from the outer wall, to provide a free pathway 78 therebetween for the passage of the rebounding abrasive particles. The paddle wheel 74 is supported on a shaft 80 mounted for rotational movement in the direction indicated by the arrow, whereby abrasive particles falling back through the corridor will be intercepted by the paddles 82 which impart kinetic energy to the intercepted abrasive particles sufficient to enable the particles to reach the end of the rebound corridor.

The blades of the paddle wheel are fabricared of a highly wear resistant material, such as steel, polyurethane, rubber and the like. The wheel is driven externally of the housing, either by a direct motor drive or indirectly by the motor used to drive the centrifugal wheel or the motor for maneuvering the apparatus over the surface, such indirect connection being achieved either by means of a belt connection or connecting gears.

The paddle wheel can be used as a means separate and apart from the ledge or in combination with the ledge for material recovery and, by the same token, the ledge may be used alone or in combination with the paddle wheel.

The few abrasive particles which do not contact the wheel 80 fall back to the surface and pass under the seal 56 from the blast chamber. These particles are picked up by a trailing auxiliary pick-up unit, such as a vacuum cleaner 80, magnetic drum, rotating brush, or the like. The small amount of dust, fines and abrasive particles, picked up by the auxiliary unit, are carried through ducts 82 to the air wash for separation of the abrasive particles for recovery. It will be understood that the power requirements for operating such auxiliary unit to pick up the small amount of abrasive particles remaining as a residual on the surface 18 is many times smaller than the power that would otherwise be required fully to recover the abrasive particles within the blast unit itself.

The great majority of the abrasive particles, entrained dust and fines, rebound with sufficient kinetic energy to pass through the rebound corridor for cleaning and return to the supply hopper. As a result, it is possible markedly to increase the recovery capability of the device without placing great reliance on auxiliary recovery systems which can therefore be made to operate simply and in a very efficient manner and without the need to take up much space or energy for substantially complete recovery of the abrasive particles.

In the illustrated modification, the air wash comprises a series of vertically spaced apart ledges 90, 92 and 94 which extend from opposite vertically disposed, spaced parallel walls 96 and 98 into overlapping relation thereby to define an arcuate pathway therebetween. The collected solids overflow one ledge and fall onto the ledge underneath and finally as a thin curtain through a cross-current of air emanating from an inlet 100 whereby fines and dust are air washed from the falling curtain of particulate material and carried with the air into duct 62 to a dust collector 102. The cleaned particulate material continues to fall gravitationally from the ledges, through the air wash and into the hopper 38 for recycle as feed to the wheel 30.

The blast corridor 44, rebound corridor 52, and paddle wheel 80 each extend crosswise for a distance corresponding to the width of the unit.

The abrasive particles are thrown from the wheel blades in a somewhat rectangular pattern that spreads substantially to cover the exit opening from the blast corridor. Thus the wall portion adjacent the exit opening from the blast corridor is preferably lined with replaceable wear plates 110 and 112 to prevent abrasive wear on the walls of the housing. The corridors are enclosed by side walls 104 from which resilient skirts 106 extend into engagement with the surface to define, with the skirts 48 and 57, a resilient seal about the blast areas. The cleaning effect is derived, at least in part, by the beat of the abrasive particles thrown sequentially by the radially spaced blades of the wheel, while the latter is rotating at high speed.

Instead of making use of gravity feed from the hopper to the wheel, use can be made of other systems for feeding particulate material to the wheel such as a pneumatic feed, screw feed, or other means for positive displacement of abrasive particles in the desired amounts. Under such circumstances, it is not essential to have the rebound corridor rise to a certain level, although it is preferred that the rebound corridor terminate at a downward incline so as to be able to take advantage of gravitational forces for continued processing of the recovered particles.

From the foregoing, it will be apparent that an apparatus is provided for the treatment of surfaces in which utilization is made of kinetic energy resident in the abrasive particles and which also harnesses gravitational force to enable recovery of the abrasive particles in an efficient and economical manner whereby size, weight and cost of the unit can be greatly reduced, while providing greater maneuverability, by hand or by power operated means, over the surface to be treated.

It will be understood that changes may be made in the details of construction, arrangement and operation without departing from the spirit of the invention, especially as defined in the following claims.

I claim:

1. A portable apparatus for treatment of horizontally disposed surfaces comprising:

1. a housing:
2. means on said housing above the surface for projecting abrasive particles downwardly onto the surface at an angle with the surface:
   2*a*. a hopper on said housing for feeding abrasive particles to said projection means:
3. a rebound corridor in said housing extending angularly upwardly from the surface into which the abrasive particles rebound upon striking said surface;
4. means on said housing at the end of the rebound corridor for returning abrasive particles passing through the corridor to the hopper; and
5. means extending into the rebound corridor for a short distance from the wall of the corridor for intercepting abrasive particles which do not possess sufficient kinetic energy to rebound through the corridor to prevent return of said abrasive particles to the surface.

2. An apparatus as claimed in claim 1 in which the abrasive particles are projected onto the surface at an angle within the range of 30° to 80° with the surface.

3. An apparatus as claimed in claim 1 in which the rebound corridor extends curvilinearly upwardly and terminates in a reverse end portion which extends angularly downwardly.

4. An apparatus as claimed in claim 1 in which the rebound corridor extends angularly upwardly to a level above the feed hopper for gravitational flow of abrasive particles from the rebound corridor to the hopper.

5. An apparatus as claimed in claim 4 which includes an air wash between the end of the rebound corridor and the hopper for the removal of dust and fines from the abrasive particles returned to the hopper.

6. An apparatus as claimed in claim 1 in which the means for intercepting abrasive particles comprises a substantially horizontally disposed ledge which extends inwardly into the rebound corridor into the path of abrasive particles falling back through the corridor, and means for displacement of abrasive particles collected on the ledge to the hopper.

7. An apparatus as claimed in claim 1 in which the ledge extends inwardly a short distance from a wall of the rebound corridor and in which the means for displacement comprises a passage communicating the ledge with the hopper through which the abrasive particles flow from the ledge to the hopper.

8. An apparatus as claimed in claim 7 in which the passage is in the form of a slot which extends angularly downwardly from the ledge and through which the abrasive particles flow by gravity from the ledge to the hopper.

9. An apparatus as claimed in claim 6 in which the ledge is located on the inner reversely bent wall of the rebound corridor.

10. An apparatus as claimed in claim 1 in which the means for intercepting abrasive particles comprises a paddle wheel mounted for rotational movement about an axis parallel with the surface and having a peripheral portion of the paddles of the wheel extending into a portion of the rebound corridor into the path of abrasive particles falling back through the corridor, and means for rotating the paddle wheel in a direction to reverse the direction of flow of abrasive particles intercepted by the paddles of the rotating wheel.

11. An apparatus as claimed in claim 10 in which the paddle wheel is positioned adjacent the inner wall of the rebound corridor and extends for a short distance into the rebound corridor.

12. An apparatus as claimed in claim 10 in which the paddle wheel is located adjacent the lower entrant end of the rebound corridor.

13. An apparatus as claimed in claim 1 which includes means for displacement of intercepted abrasive particles to the hopper.

* * * * *